US005458560A

United States Patent [19]

Kaiser et al.

[11] Patent Number: 5,458,560

[45] Date of Patent: Oct. 17, 1995

[54] CONTINUOUS PASSIVE MOTION DEVICE FOR A WRIST

[75] Inventors: Robert T. Kaiser, Mount Laurel, N.J.; Robert Zambelli, Sellersville; George Telepko, Fort Washington, both of Pa.; Berdj C. Kalustyan, Moorestown; Vero Ricci, Collingswood, both of N.J.

[73] Assignee: Jace Systems, Inc., Moorestown, N.J.

[21] Appl. No.: 116,316

[22] Filed: Sep. 3, 1993

[51] Int. Cl.[6] ..... A61H 1/00

[52] U.S. Cl. ..... 601/40; 601/33; 601/93

[58] Field of Search ..... 601/23, 29, 40, 601/89, 93, 97, 101, 103, 104, 27, 31–35; 128/782; 73/379.01, 379.02; 602/20, 21; 482/44–46

[56] References Cited

U.S. PATENT DOCUMENTS

| | | | |
|---|---|---|---|
| Re. 33,182 | 3/1990 | Pecheux . | |
| 1,177,398 | 3/1916 | Dorang . | |
| 2,553,277 | 5/1951 | Robinson et al. . | |
| 2,832,334 | 4/1958 | Whitelaw . | |
| 3,020,908 | 2/1962 | Daniels et al. . | |
| 3,457,912 | 7/1969 | Clark et al. . | |
| 3,631,542 | 1/1972 | Potter . | |
| 4,538,595 | 9/1985 | Hajianpour | 601/33 |
| 4,558,692 | 12/1985 | Greiner | 601/33 |
| 4,576,148 | 3/1986 | Koerner et al. . | |
| 4,601,468 | 7/1986 | Bond et al. . | |
| 4,660,550 | 4/1987 | Bodine . | |
| 4,665,899 | 5/1987 | Farris et al. | 601/34 |
| 4,665,900 | 5/1987 | Saringer . | |
| 4,716,889 | 1/1988 | Saringer . | |
| 4,724,827 | 2/1988 | Schenck | 601/40 |
| 4,784,120 | 11/1988 | Thomas . | |
| 4,825,852 | 5/1989 | Genovese et al. | 601/34 |
| 4,834,073 | 5/1989 | Bledsoe et al. | 601/34 |
| 4,875,469 | 10/1989 | Brook et al. . | |
| 4,899,735 | 3/1990 | Townsend et al. . | |
| 4,905,676 | 3/1990 | Bond et al. . | |
| 4,962,756 | 10/1990 | Shamir et al. . | |
| 5,025,801 | 6/1991 | Callaway . | |
| 5,060,638 | 10/1991 | Bodine, Jr. . | |
| 5,067,479 | 11/1991 | Saringer et al. . | |
| 5,115,806 | 5/1992 | Greuloch et al. . | |
| 5,170,776 | 12/1992 | Pecheux | 601/93 |
| 5,303,696 | 4/1994 | Boice | 601/40 |

*Primary Examiner*—Richard J. Apley
*Assistant Examiner*—Jeanne M. Clark
*Attorney, Agent, or Firm*—Panitch Schwarze Jacobs & Nadel

[57] ABSTRACT

A therapeutic passive motion device for rehabilitating a wrist includes a main housing unit which encloses a reciprocating motion producing device. A yoke member extends outwardly from the main housing unit. A first, generally V-shaped, link mechanism is pivotally connected to an end of the yoke and carries a hand-supporting member. A second link mechanism is pivotally connected to an output member of the motion producing device and to the first link mechanism. An electric motor is advantageously employed to drive the motion producing device, whereby the hand-supporting member is caused to pivot in an oscillating fashion relative to the yoke member and the main housing unit.

26 Claims, 9 Drawing Sheets

46
120
36
38
34
118
124
126
44
30
40
28
44
78
32
34
76
78
48b
24
30
20
48
48b
48
48b
32
22
26

FIG. 9
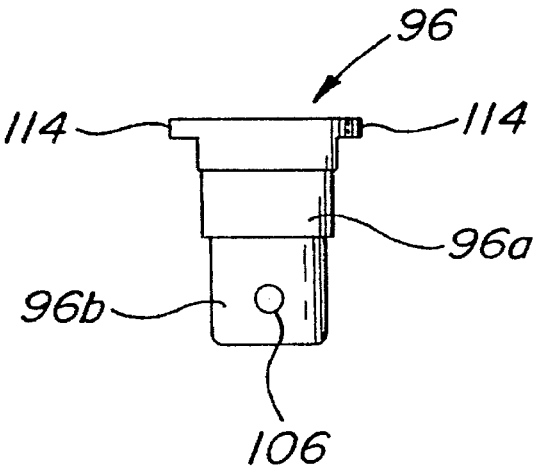
FIG. 10
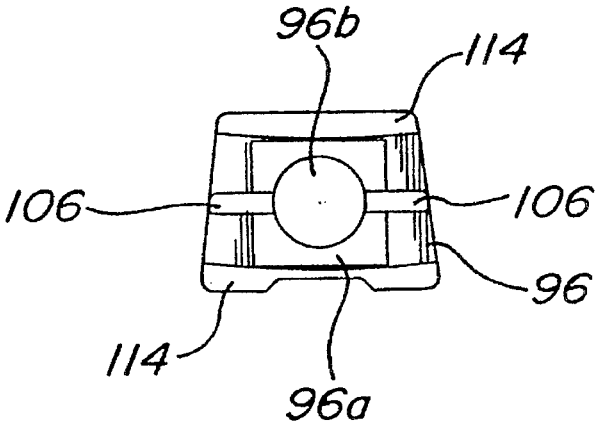
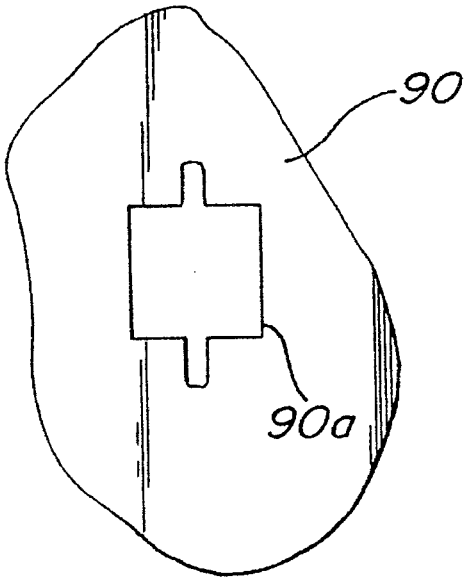
FIG. 11

CONTINUOUS PASSIVE MOTION DEVICE FOR A WRIST

FIELD OF THE INVENTION

The present invention relates to devices which effect continuous passive motion of a limb or joint. More particularly, the present invention relates to portable devices which produce continuous and/or cyclic movements in a human wrist while the wrist remains in a passive state.

BACKGROUND OF THE INVENTION

In the field of post-trauma and post-operative physical therapy for the rehabilitation of joints, it is generally known that the occurrences of capsular, ligamentous and articular adhesions, thromboembolisms, venous status, post-traumatic osteopenia, peripheral edema, muscle atrophy and the like can be reduced by an early mobilization of the injured or surgically treated joint with a continuous passive motion device (CPM).

Various continuous passive motion devices have been proposed for effecting post-trauma or post-operative movements of an injured or surgically treated limb or joint. These devices are often driven by an electric motor and operate to continuously and repeatedly flex the affected or associated joint at a predetermined speed and through a predetermined range of motion. Moreover, these devices may be specially adapted for use in conjunction with a particular joint, such as a knee, elbow or wrist. An example of a motor driven CPM that is specially adapted for use e.g. in the rehabilitation of a knee or hip joint is disclosed in U.S. patent application Ser. No. 07/760,291, entitled "Continuous Passive Motion Device for a Limb" assigned to the assignee of the present invention and incorporated by reference herein.

In designing a portable continuous passive motion device, the size and/or the power output capacity of the motor is chosen in dependence not only on an actual anticipated load which the device is likely to encounter during operation (such as the weight or the resistance to movement of a leg, arm or hand), but also on the effective "gearing ratio" (or mechanical advantage) which exists between the motor and the limb or joint moving member of the CPM. This effective gearing ratio is a function of the particular motion conversion mechanism which is utilized in the CPM to change the (e.g. rotary) output motion of the motor into the (e.g. oscillatory or reciprocating) output motion of the limb or joint moving member. Moreover, depending on the particular motion conversion mechanism which is utilized, the effective gearing ratio between the motor and the limb or joint moving member may vary e.g. over the range of movement of the limb or joint moving member.

A continuous passive motion device for a wrist is known, for example, from U.S. Pat. No. 5,067,479. This device employs an eccentric transmission for driving a pivoting slide to convert a rotary motion of an electric motor into a pivoting motion of a wrist-supporting tubular shaft driven by the slide. As will become apparent to those skilled in the art, the effective gearing ratio (or mechanical advantage) of such a motion conversion mechanism ranges from a minimum when an axis of the pivoting slide is parallel to an effective working radius of the eccentric transmission (e.g. when the wrist is in an unflexed position) to a near infinite maximum when the axis of the pivoting slide is disposed tangentially to and parallel with the plane of an effective circumference defined by the effective working radius of the rotating eccentric transmission. Due to the relatively large variance in the effective gearing ratio of such a motion conversion mechanism, the selection of a proper size and/or power output capacity for the electric motor is necessarily controlled by countervailing functional and practical design constraints. Specifically, if a relatively large size and/or power output capacity for the electric motor is chosen so as to accommodate the actual anticipated load when the effective gearing ratio is at the minimum, then that motor exhibits a substantial overcapacity in power output when the wrist-supporting tubular shaft is at a position where the minimum effective gearing ratio does not exist. Conversely, if a relatively small size and/or power output capacity for the electric motor is chosen so as to reduce an overcapacity condition in the power output of the motor when the effective gearing ratio is not at a minimum, then the power output capacity of that motor may be inadequate to overcome the actual anticipated load when the wrist-supporting tubular shaft is at a position where the minimum effective gearing ratio exists in the motion conversion device.

While a relatively large motor functions adequately even when the minimum effective gearing ratio exists in the motion conversion device of the CPM, several practical design constraints weigh against the selection of such a motor. Specifically, both the cost and the aesthetic appearance of the CPM are adversely affected by the selection of a relatively large motor. Also, fin order to accommodate the larger reaction forces generated by the relatively large motor, the design of the CPM housing necessarily becomes more complex. Additionally, a relatively large motor consumes more electric power than a relatively small motor.

Accordingly, it will become apparent that the selection of the proper size and/or power output capacity of an electric motor for a portable wrist CPM with an eccentric transmission-type motion conversion mechanism involves a balancing of, or alternately, a compromise between, functional and practical design constraints.

SUMMARY OF THE INVENTION

Briefly stated, the present invention is directed toward a therapeutic passive motion device for effecting wrist movement in a user. The device includes a main housing unit and a yoke member rigidly supported by and extending outwardly from the main housing unit. A first link mechanism is pivotally connected to an end of the yoke member remote from the main housing unit at a first pivotal connection, and a hand-supporting assembly is mounted on the first link mechanism. In use, the main housing unit is adapted to be secured to the forearm of the user in such a manner that the associated wrist of the user is in general alignment with the first pivotal connection and the associated hand of the user is supported by the hand-supporting assembly. A motion producing device is mounted, for example, within the main housing unit and includes an output member which undergoes reciprocal movement. A second link mechanism is pivotally connected to the first link mechanism at a second pivotal connection and to the output member of the motion producing device at a third pivotal connection. According to the invention, the second link mechanism transforms the reciprocal movement of the output member of the motion producing device into an oscillatory movement of the first link mechanism.

BRIEF DESCRIPTION OF THE DRAWINGS

The foregoing summary, as well as the following detailed description of the presently preferred embodiment(s) of the invention, will be better understood when read in conjunction with the appended drawings. For the purpose of illustrating the invention there is shown in the drawings an embodiment which is presently preferred. It should be understood, however, that the present invention is not limited to the particular arrangements and instrumentalities shown. In the drawings:

FIG. 9 is an elevational view of a slide member used to connect a hand-supporting member to the wrist CPM shown in FIG. 1;

FIG. 10 is a bottom plan view of the slide member shown in FIG. 9;

FIG. 11 is a sectional view of the wrist CPM taken along lines 11—11 of FIG. 4;

DETAILED DESCRIPTION OF THE PREFERRED EMBODIMENTS

Figure 1:
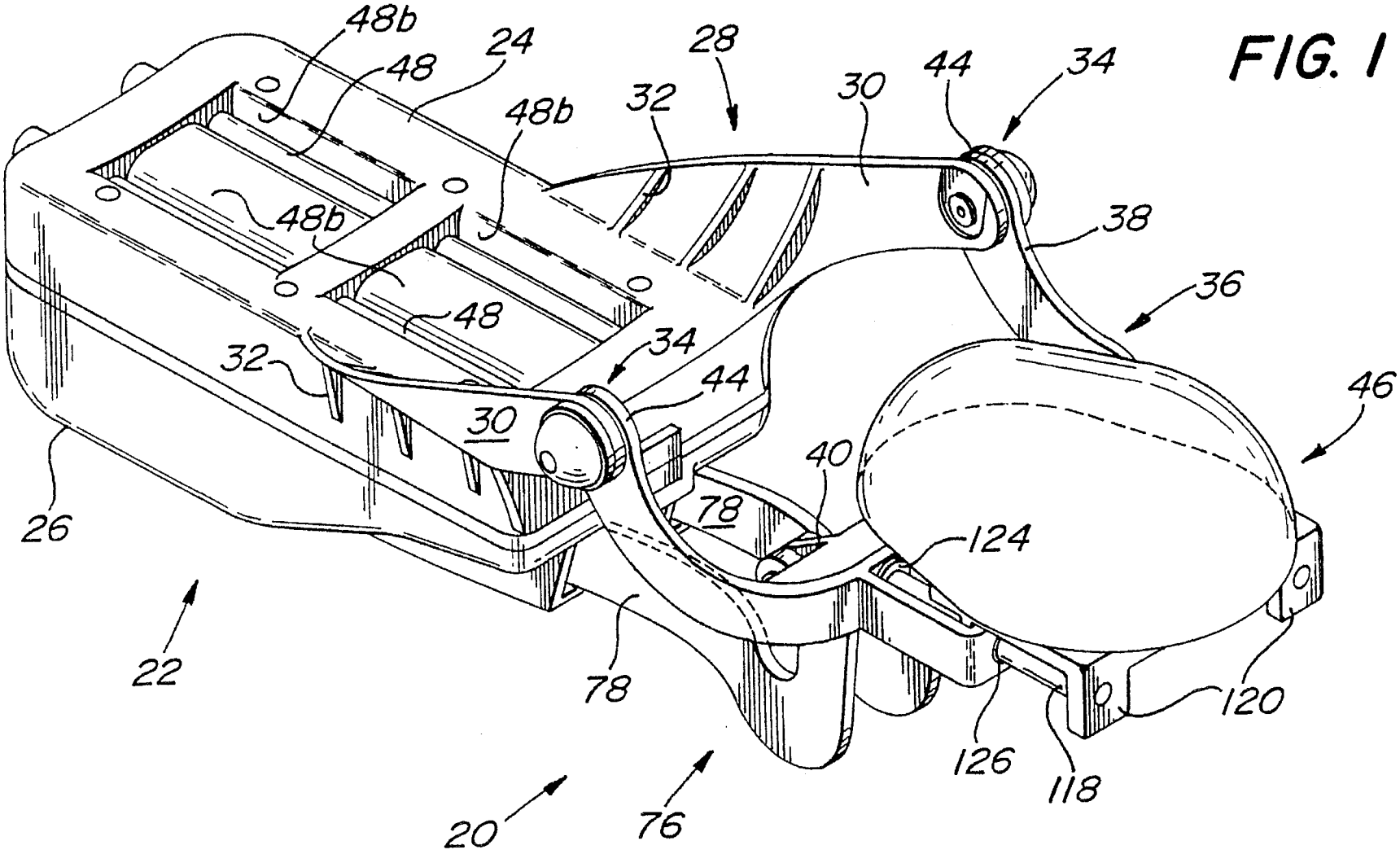
FIG. 1 is a perspective view of a wrist CPM according to an embodiment of the invention.

Certain terminology is used in the following description for convenience only and is not limiting. For example, the words "right", "left", "lower" and "upper" designate directions in the drawings to which reference is made. The words "above" and "below" refer to relative positions in the drawings to which reference is made. The words "inwardly" and "outwardly" refer to directions toward and away from the geometric center of the wrist CPM or designated parts thereof. The certain terminology will thus include the words above specifically mentioned, derivatives thereof, and words of similar import.

Referring now to the drawings in detail, wherein like numerals indicate like elements throughout, there is shown in FIGS. 1 to 11 a preferred embodiment of a continuous passive motion device (CPM) for a wrist, indicated generally at 20. The wrist CPM 20 includes a main housing unit 22 (made from plastic or other suitable lightweight, high strength materials) having an upper portion 24 and a lower portion 26 which cooperate in a clamshell-type manner to form an enclosure for a motion producing device and other associated internal components of the CPM, as will be more fully described below. A yoke member 28, which includes two spaced-apart arms 30, is rigidly supported by and extends outwardly from the upper portion 24 of the main housing unit 22. In the preferred embodiment, the yoke member 28 is formed integrally with the upper portion 24 of the main housing unit 22 from the same material. However, the yoke member 28 may also constitute a separate article, which may be formed of a different material, which is attached to the main housing unit 22. A plurality of stiffening ribs 32 are preferably integrally provided on each of the arms 30 and in the area between each of the arms 30 and the upper portion 24 of the main housing unit 22 to provide enhanced structural support and strength to the arms 30.

Figure 5:
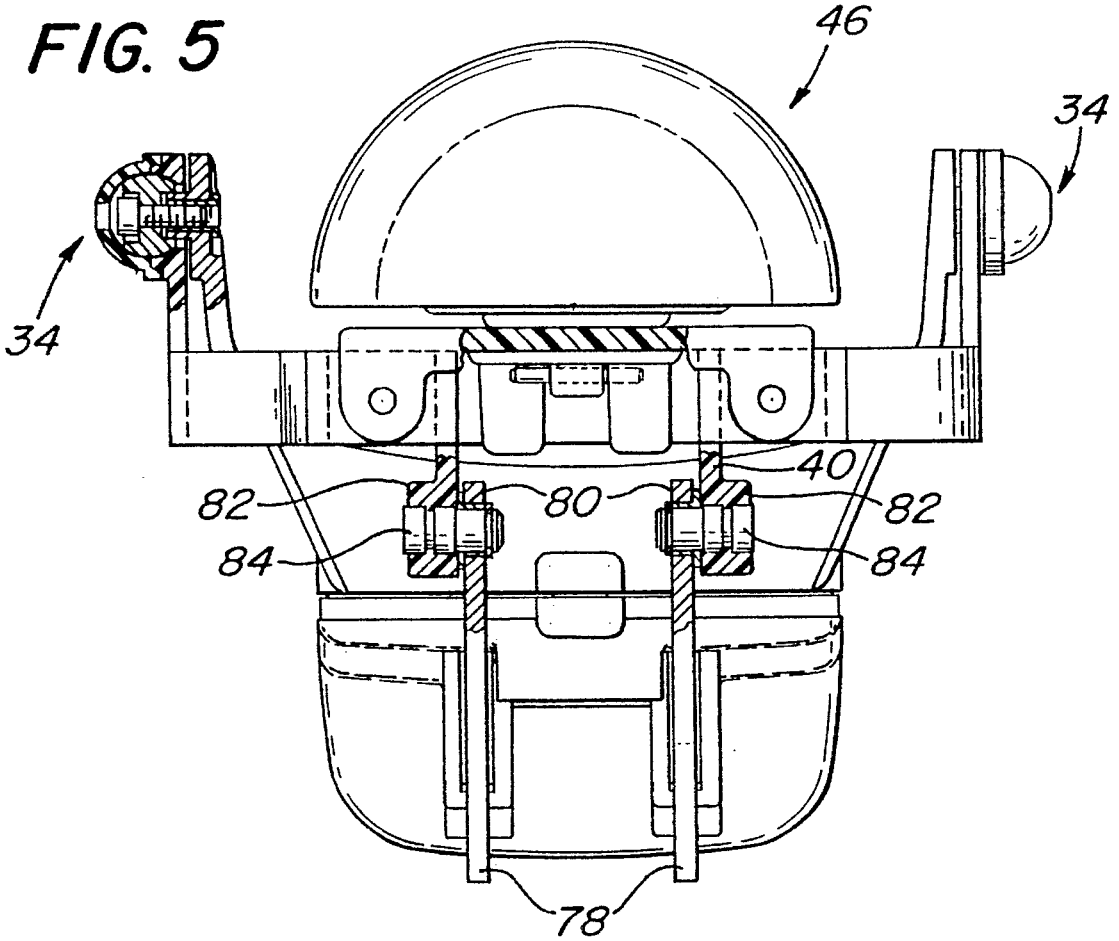
FIG. 5 is a partially cut-away frontal view of the wrist CPM shown in FIG. 1.

At the outward (i.e. remote from the main housing unit 22) ends of the two spaced-apart arms 30, generally coaxially arranged first pivotal connection parts 34 (which together comprise a first pivotal connection) are provided to pivotally connect the outer ends of each of the spaced-apart arms 30 to a first link mechanism 36. As shown in FIG. 5, the first pivotal connection parts 34, in the present embodiment, advantageously take the form of ball joints which accommodate a small amount of relative angular movement between the yoke 28 and the first link mechanism 36 about axes perpendicular to the pivot axis of the first pivotal connection parts 34. Other types of pivotal connecting components may alternatively be employed.

Figure 4:
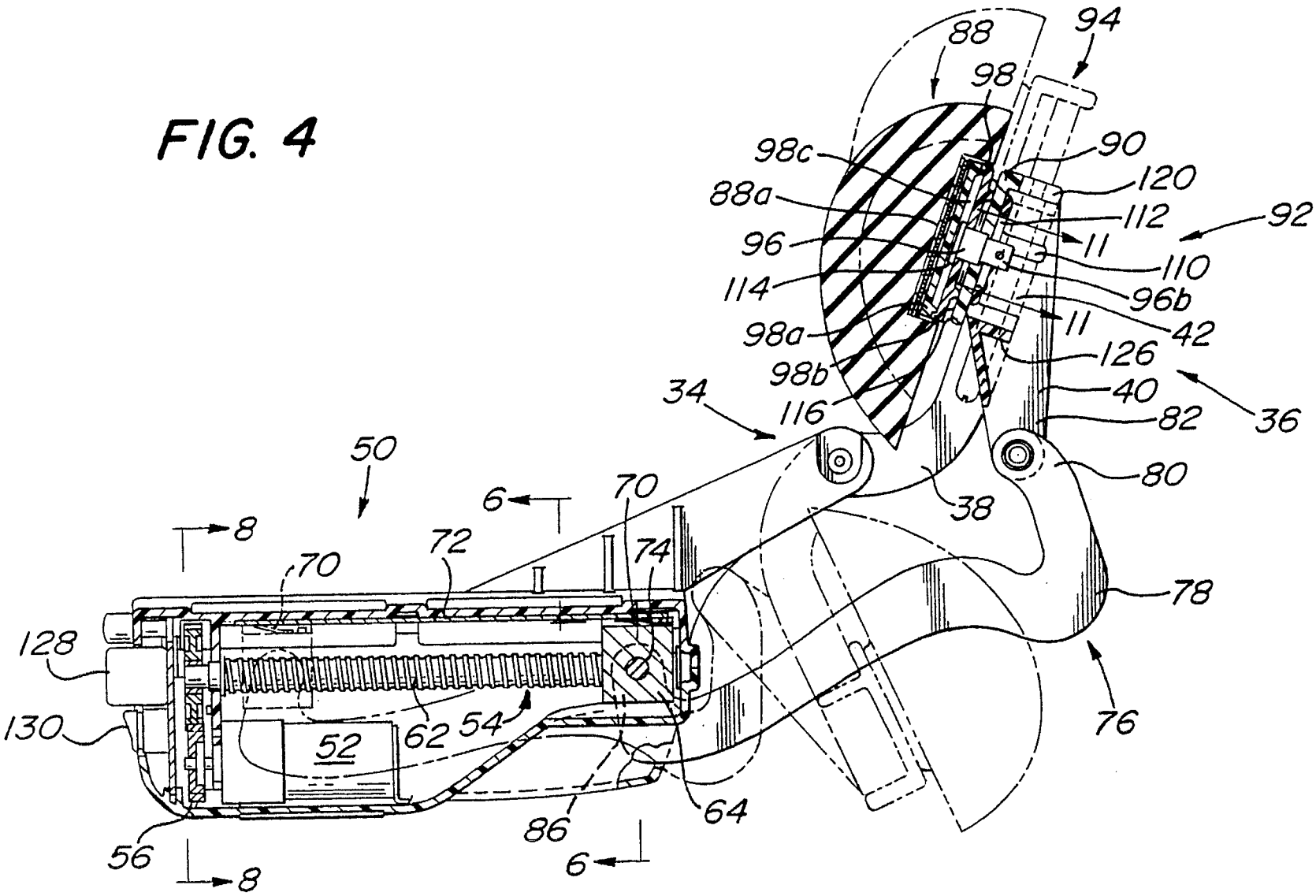
FIG. 4 is a longitudinal cross-sectional view taken along lines 4—4 in FIG. 2.

As shown most clearly in FIGS. 1 and 4, the first link mechanism 36 (also made from plastic or other lightweight, high strength suitable material) is generally V-shaped when viewed from the side or when viewed in longitudinal cross-section. The first link mechanism 36 comprises a first bifurcated leg portion 38 and a second bifurcated leg portion 40 which are joined to one another (e.g. so as to form an acute angle therebetween) in the vicinity of an apex or apex portion 42. As such, in the preferred embodiment, the first link mechanism is a rigid, unitary torque/force-transmitting member. The term "link mechanism" as used herein encompasses both a unitary torque/force-transmitting member made from a single piece and a torque/force-transmitting arrangement made from a plurality of pieces which function in unison.

The first bifurcated leg portion 38 terminates in a pair of free ends 44 at a position remote from the apex portion 42. These free ends 44, which together constitute an end portion of the first bifurcated leg portion 38, are connected to an end of the yoke member 28 (constituted by the outer ends of the spaced-apart arms 30) remote from the main housing unit 22 at the first pivotal connection. A hand-supporting assembly 46 is mounted on the first link mechanism 36 at a position near the apex portion 42 in a manner which will be hereinafter more fully described.

Figure 6:
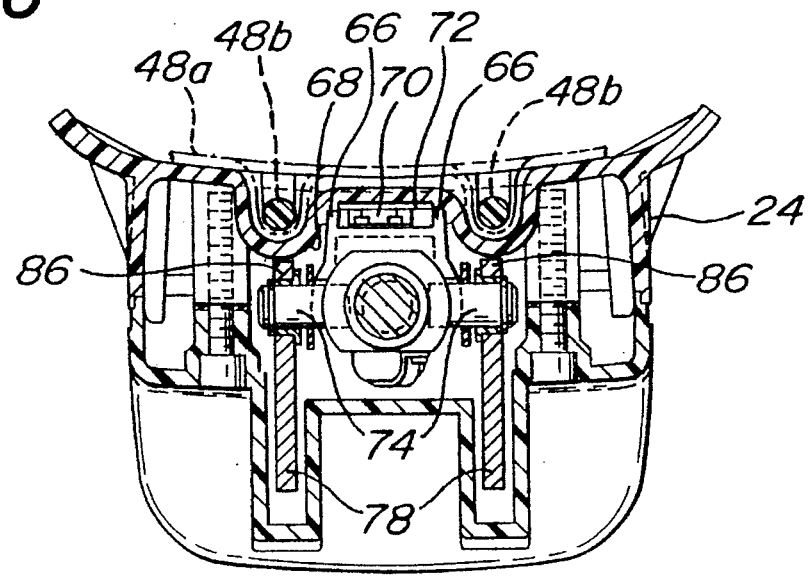
FIG. 6 is a transverse cross-sectional view taken along lines 6—6 in FIG. 4.

As will become apparent to those skilled in the art, the main housing unit 22, the yoke member 28, the first pivotal connection parts 34, and the hand-supporting assembly 46 are arranged in such a manner that when the main housing unit 22 is properly secured to a forearm of a user, the carpal joint of the user's wrist is in general alignment with the first pivotal connection and the user's hand is (e.g., substantially horizontally) supported by the hand-supporting assembly 46, as described below. For the purpose of properly securing the forearm of the user to the main housing unit 22, the upper portion 24 of the main housing unit is provided with a plurality of longitudinally arranged securing elements 48 (which may take the form of selectively removable rods). In the preferred embodiment, the forearm of the user is secured to a forearm splint 48*a* (only a portion of which is shown in FIG. 6) which includes two sets of two parallel channels 48*b* (see FIGS. 1 and 6) each for slidably receiving a securing element 48. Alternatively, straps or attaching portions of soft goods (not shown in FIG. 1) can be adapted to be fed beneath the securing elements 48 and wrapped around the user's forearm, whereby the user's forearm may be secured to the top portion 24 of the main housing unit 22 without the need for the splint 48*a*. While the user's hand can merely rest on the hand-supporting assembly 46, it is preferred that a strap (not shown) be used to secure the user's hand to the hand-supporting assembly.

A motion producing device, indicated generally at 50 in FIG. 4, is enclosed within the main housing unit 22. The motion producing device 50 includes a reversible electric motor 52 having a rotary output or output shaft (unnumbered) which drives a ball screw and nut mechanism 54 through a gear transmission 56. The ball screw and nut mechanism 54 has a constant gearing ratio throughout its range of operation and functions as a motion conversion device for converting the reversing rotary driving motion of the electric motor output shaft into reciprocating motion.

Figure 8:
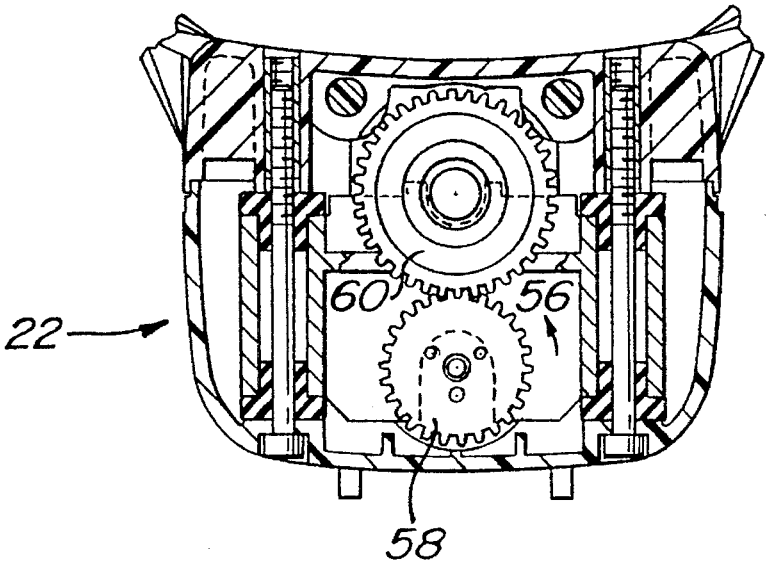
FIG. 8 is a transverse cross-sectional view taken along lines 8—8 in FIG. 4.

As shown in particular in FIG. 8, the gear transmission 56 is, in the preferred embodiment, a reduction gear transmission which comprises a drive gear 58 attached to the output shaft of the motor 52 that engages a driven gear 60. The driven gear 60 is drivingly connected to a linear screw 62 (FIG. 4) of the ball screw and nut mechanism 54. The linear screw 62 is journalled for rotation within the main housing unit 22 between the upper and lower portions 24, 26. A non-rotatable nut or nut assembly 64 is carried by the linear screw 62 and driven in a reciprocating fashion by the reversing rotation of the linear screw 62. The nut assembly 64 constitutes the linear output member of the motion producing device 50.

Details of the nut assembly 64 are shown in FIGS. 4 and 6. Specifically, the nut assembly 64 includes upstanding guide projections 66 which are received within a longitudinally extending interior guide channel 68 formed in the upper portion 24 of the main housing unit 22. The guide projections 66 and guide channel 68 cooperate to prevent rotation of the nut assembly 64. Vertically between the nut assembly 64 and the upper portion 24 of the main housing unit 22, a sensing assembly (in the form of a linear potentiometer) is provided for sensing the linear position of the nut assembly along the linear screw. In particular, a conductive wiper 70 of the linear potentiometer is fixed to a top portion of the nut assembly 64. Above the wiper, an electrically conductive resistance strip 72 (having a known electrical resistance per unit of length), and a parallel conductive path are fixed to the upper portion 24 of the main housing unit 22. As the nut assembly reciprocates along the linear screw 62, the conductive wiper 70 slides along both the resistance strip 72 and the parallel conductive path. A sensed electrical resistance ratio between the parallel conductive path and each end of the resistance strip 72 provides an indication of the linear position of the nut assembly 64 along the linear screw 62 for control purposes which will hereinafter be described. Lastly, as shown in FIG. 6, a pair of horizontally disposed and laterally opposed pivot pins 74 extend outwardly from the nut assembly 64.

It is noted that, in the preferred embodiment, conventional antifriction elements are employed in the nut assembly 64 to reduce the amount of friction generated between the linear screw 62 and the nut assembly 64. These antifriction elements may take the form of recirculating or non-recirculating ball bearings (not shown) which are provided at the mechanical interface between the linear screw 62 and the nut assembly 64. Other types of antifriction elements may alternatively be employed.

The output member of the motion producing device 50 drives the first link mechanism 36 to pivot about the pivotal connection 34 by means of a second link mechanism 76. Specifically, as shown in FIGS. 4 to 6, a pair of curved links 78 (which together constitute the second link mechanism 76) include a pair of first ends 80 (which together constitute a first end portion of the second link mechanism 76) and a pair of second ends 86 (which together constitute a second end portion of the second link mechanism 76). Free ends 82 of the second bifurcated leg portion 40 (which together constitute an end portion of the second bifurcated leg portion 40) of the first link mechanism 36 are pivotally connected to the first ends 80 of the curved links 78 by means of a pair of second pivotal connection parts 84 (which together constitute a second pivotal connection). The curved links 78 are pivotally connected at their second ends 86, by means of a third pivotal connection, to the output member of the motion producing device 50 i.e through the intermediary of the opposed pivot pins 74 which extend outwardly from the nut assembly 64. Accordingly, during operation of the CPM, the second link mechanism 76 functions as a force-transmitting member between the output member (i.e. the nut assembly 64) of the motion producing device 50 and the second bifurcated leg portion 40 of the first link mechanism 36 to transform the reciprocating movement of the nut assembly 64 into an oscillatory movement of the first link mechanism 36 about the pivot axis defined by the first pivotal connection parts 34. Moreover, it becomes apparent that the first and second link mechanisms 36, 76 and the yoke member 28 attached to the main housing unit 22 together cooperate to form an offset slider-crank motion conversion device for transforming the reciprocating movement of the output member 64 of the motion producing device 50 into an oscillatory pivoting movement of the hand-supporting assembly 46.

Figure 2:
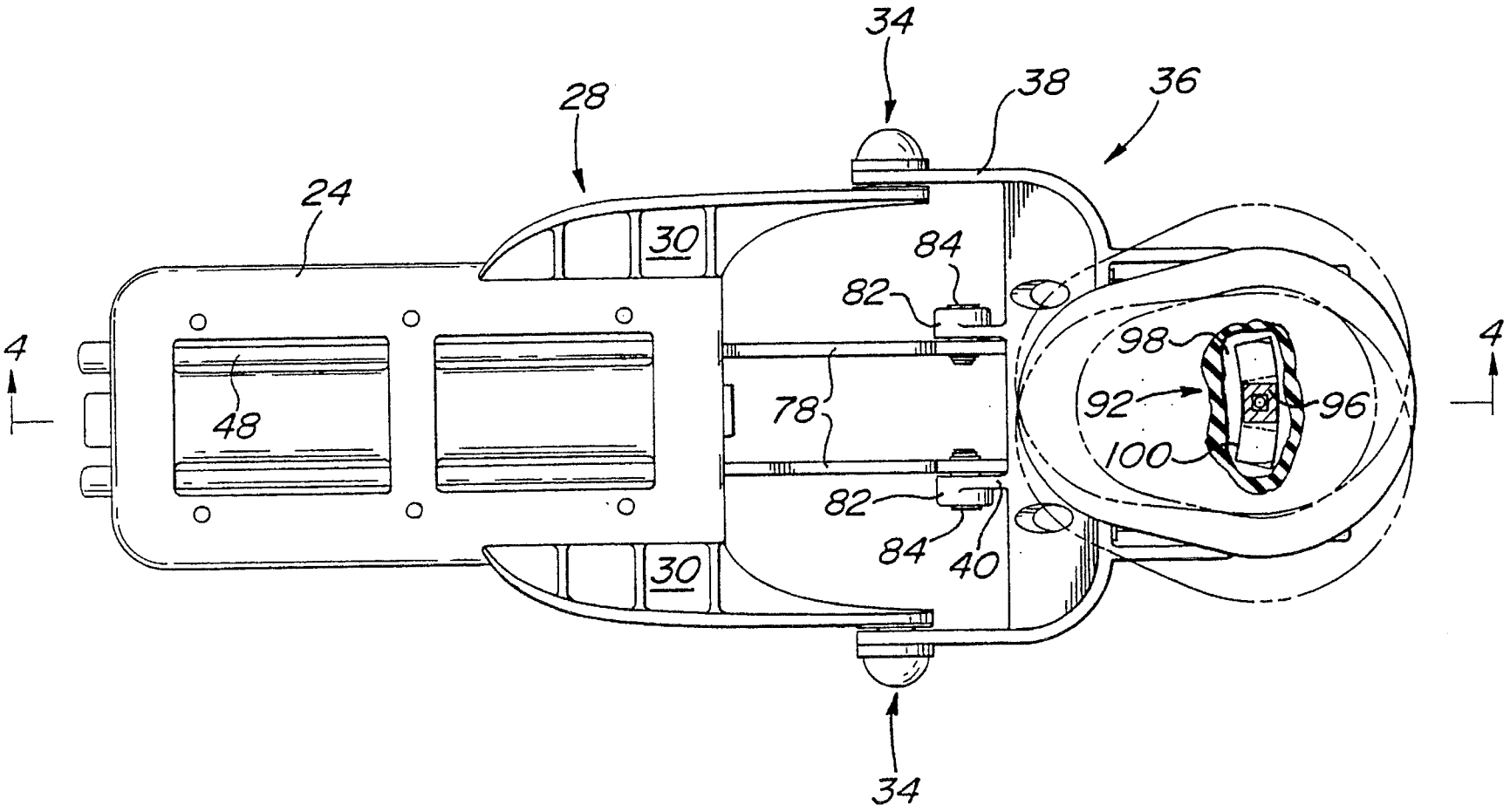
FIG. 2 is a top view, partially broken away, of the wrist CPM shown in FIG. 1.

FIGS. 1, 2 and 4 reveal the details of the preferred embodiment of the hand-supporting assembly 46 shown in FIG. 1. Specifically, as shown in FIG. 4, the hand-supporting assembly comprises a hand-supporting member 88 preferably made of a resilient material such as a rubber pad or the like secured to a base plate assembly 98 which is mounted on a supporting plate 90 by means of an arcuate slide assembly, indicated generally as 92. The hand-supporting member 88 is preferably releasably secured to the base plate 98 with hook-and-loop material 88*a*. The supporting plate 90, in turn, is mounted on the first link mechanism 36 at a position near the apex portion 42 thereof by means of a linear slide assembly, indicated generally as 94. As shown e.g. in FIG. 3, a line of movement of the arcuate slide assembly 92 extends generally transversely to a line of movement of the linear slide assembly 94.

Referring now to FIGS. 4 and 9–11, the arcuate slide assembly 92 provides for limited arcuate movement of the hand-supporting member 88 relative to the supporting plate 90. The base plate 98 includes upper and lower portions 98*a*, 98*b* adhesively secured together in a standard manner well understood by those skilled in the art. A cavity 98*c* is formed between the upper and lower portions 98*a*, 98*b*. The lower portion 98*b* includes an arcuate slot 100 (see FIG. 2). A slide member 96 is received within the arcuate slot 100 formed within the lower portion 98*b* of the base plate 98. The slide member 96 includes a pair of retaining flanges 114 positioned within the cavity 98*c* for retaining the slide member 96 within the slot 100 and to permit the slide member 96 to slide or move with respect to the slot 100 and hand-supporting member 88. A pair of radially extending locking pins 106 are formed in the opposite or distal end 96*a* of the sliding member 96 from the retaining flanges 114. Positioned between the retaining flanges 114 and the locking pins 106 is an intermediate section 96*b* which is generally square in cross section (see FIG. 10).

Referring now to FIGS. 4 and 11, the intermediate section 96*b* and locking pins 106 are positioned through a correspondingly sized aperture 90*a* in the supporting plate 90. The aperture 90*a* is sized to receive the intermediate section 96*b* therein to prevent the sliding member 96 from rotating with respect to the supporting plate 90. The sliding member 96 is maintained within the aperture 90*a* and secured to the supporting plate 90 by a lock knob 112, as described in more detail hereinafter. Thus, the hand-supporting member 88 and base plate 98 are movable with respect to the supporting plate 90 along a curved path defined by the arcuate slot 100.

The positioning and the degree of curvature of the arcuate slot 100 is chosen to generally or substantially duplicate the arc of possible lateral (or side-to-side) movement which a human hand may undergo when an associated carpal joint of the wrist is positioned to be in general alignment with the axis of the first pivotal connection parts 34. It will thus be apparent to those skilled in the art that the arcuate slide assembly 92 constitutes a mechanism by which the lateral position of the hand-supporting member 88 may be adjusted to accommodate and tailor the wrist CPM 20 to the specific needs of individual wrist CPM users.

Figure 3:
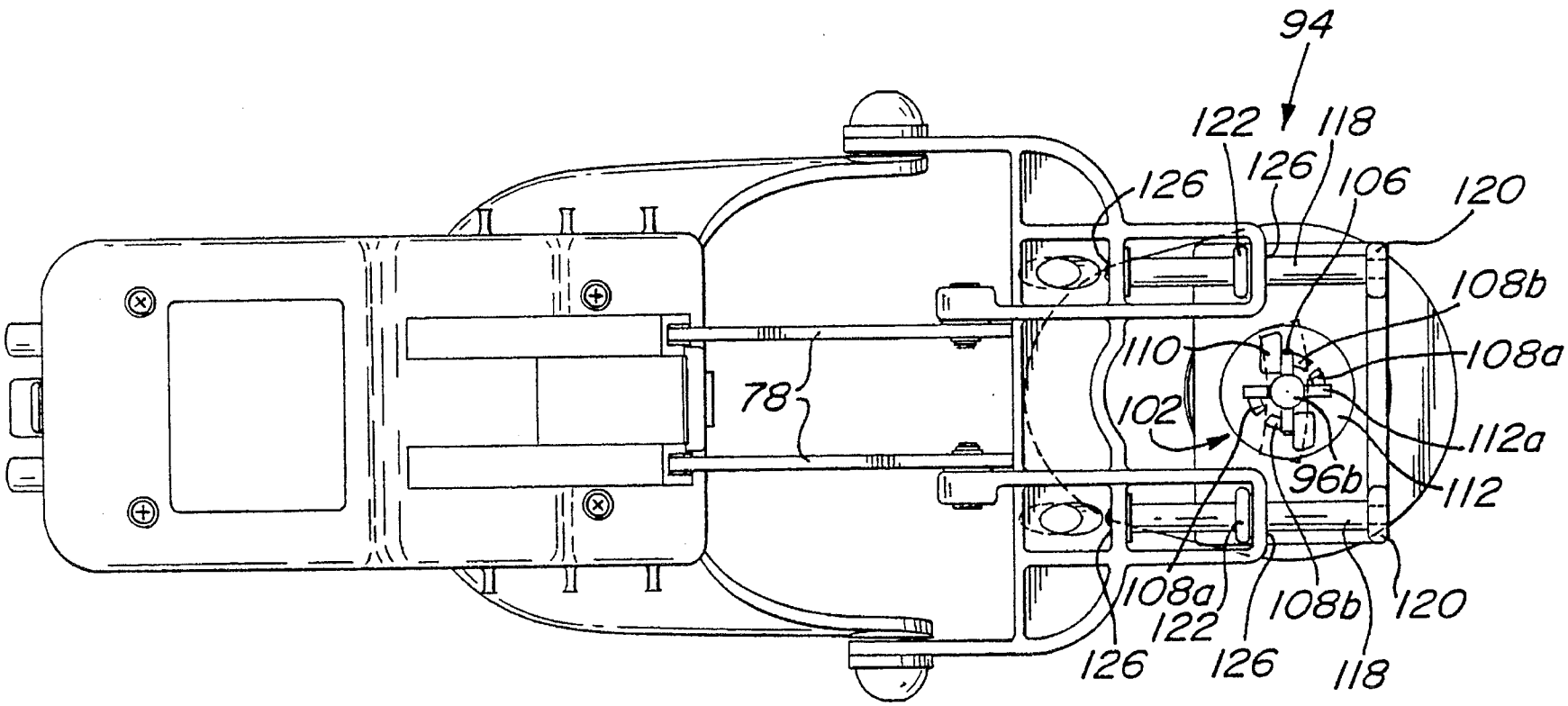
FIG. 3 is a bottom view of the wrist CPM shown in FIG. 1.

A locking assembly, indicated generally at 102 in FIG. 3, is provided to selectively lock a lateral position of the hand-supporting member 88 relative to the supporting plate 90. The locking assembly 102 includes the lock knob 112 which includes an aperture 112*a* for complementarily receiving the distal end 96*b* of the sliding member 96. That is, the locking pins 106 and generally cylindrical distal end 96*a* are positioned through the aperture 112*a* until the locking pins 106 clear the aperture 112*a*. As such, the lock knob 112 is rotatable with respect to the sliding member 96. As best shown in FIG. 3, the lock knob 112 includes first and second sets 108*a*, 108*b* of cam formations and a pair of stop elements 110 which protrude upwardly from the lock knob 112. The lock knob 112, locking pins 106 and aperture 90*a* cooperate to fasten the base plate 98 to the supporting plate 90, as described in more detail below.

Operation of the locking assembly 102 is as follows. The base plate 98 is positioned with respect to the supporting plate 90 such that the distal end 96*a* of the sliding member 96 is positioned through the aperture 90*a* in the supporting plate 90. In this position, the sliding member 96 is rotatably fixed with respect to the supporting plate 90. The lock knob 112 is then positioned to receive the distal end 96*b* of the sliding member 96 and the locking pins 106 through the aperture 112*a* of the lock knob 112. That is, the locking pins 106 are positioned through the aperture 112*a* until they are positioned on the opposite side of the lock knob 112 from the supporting plate 90. In this first angular position, the base plate 98 and sliding member 96 are easily removable from the supporting plate 90.

The lock knob 112 is then rotated clockwise (as viewed in FIG. 3) approximately 45° until the locking pins 106 are positioned between the first and second sets of cam formations 108*a*, 108*b*. In this position, the base plate 98 cannot be removed from the supporting plate 90, but is permitted to move or slide with respect to the supporting plate 90 due to the sliding connection between the sliding member 96 and the arcuate slot 100. Further rotation of the lock knob 112 clockwise approximately 45° causes the locking pins 106 to ride over the second set of cam formations 108*b*. The second set of cam formations 108*b* have a greater height than the first set of cam formations 108*a* to cause the supporting plate 90 and base plate 88 to be compressed together. In this position, the compressive forces are sufficient to lock the base plate 98 to the supporting plate 90 and prevent sliding movement between the sliding member 96 and arcuate slot 100. By moving the lock knob 112 through the three different positions, the hand-supporting member 88 can be either removed from the supporting plate 90, be permitted to move in an arcuate manner with respect to the supporting plate 90, or be fixed to the supporting plate 90.

The linear slide assembly 94 provides for limited sliding movement of the hand-supporting assembly 46 relative to the first link mechanism 36 in directions substantially towards and away from the first pivotal connection. As shown in FIG. 3, the linear slide assembly comprises a pair of slide pins 118 which are fixed to distal flanges 120 of the supporting plate 90. Each of the slide pins 118 are further supported by a flange 122 which extends downwardly from the supporting plate 90.

Each of the slide pins 118 is slidably received within guide bushings (only one of which is shown at 124 in FIG. 1) selectively provided within a plurality of guideway openings 126 (FIG. 3) that are strategically provided e.g. in the vicinity of the apex portion 42 of the first link mechanism 36. Accordingly, since the slide pins 118 are slidable (against minimal friction force created by the bushings 124) relative to the first link mechanism 36, the hand-supporting assembly 46 is free to slide as the first link mechanism 36 undergoes its angular excursion shown in FIG. 4.

Figure 7:
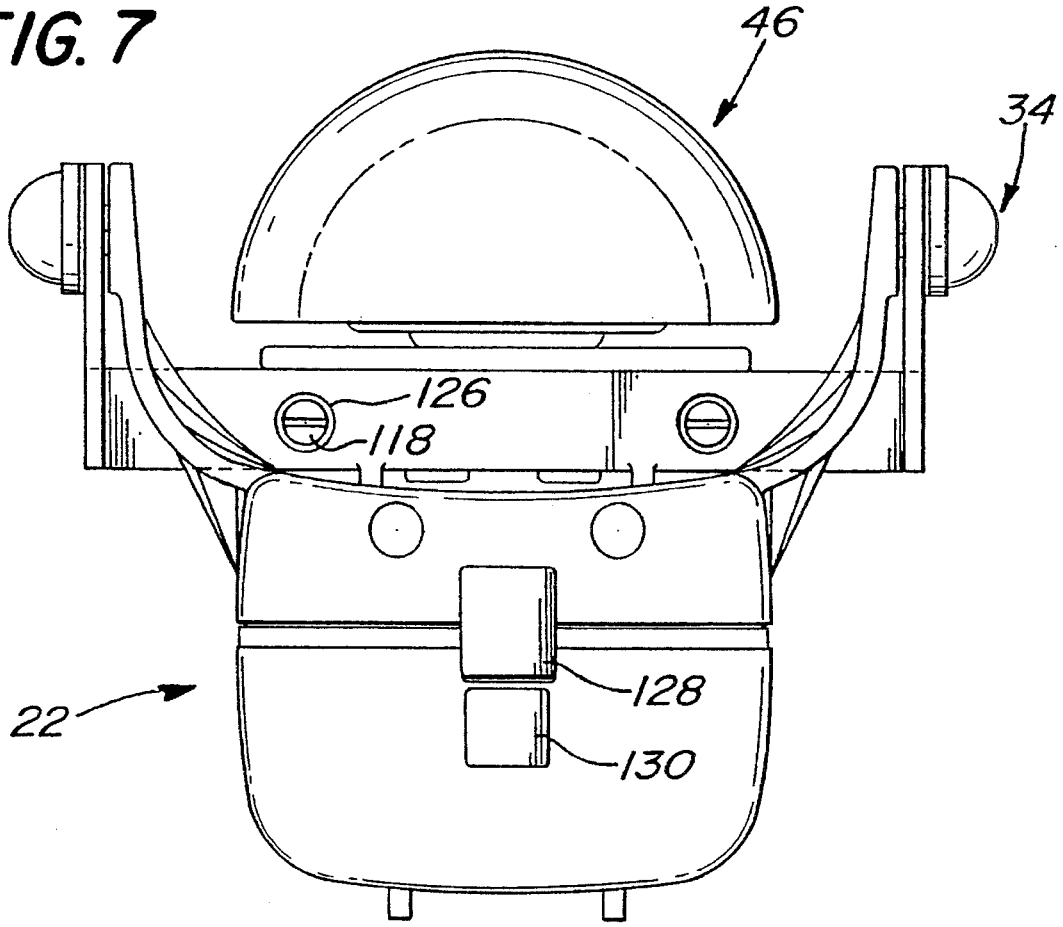
FIG. 7 is a rear view of the wrist CPM shown in FIG. 1.

The wrist CPM 20 according to the present invention is adapted for use with a remote CPM controller e.g. of the kind described in U.S. patent application Ser. No. 07/760,424 entitled "Controller for Continuous Passive Motion Devices", assigned to the assignee of the present invention and incorporated by reference herein. As shown in FIGS. 4 and 7, the main housing unit 22 of the wrist CPM 20 includes, suitably supported at a rear portion thereof, interface components including an electrical connector 128 and a user-operated momentary switch 130. The electrical connector 128 is adapted to be connected, via a suitable (e.g. six conductor) signal cable/connector assembly (not shown), to the remote CPM controller (also not shown). The CPM controller receives a signal from the linear potentiometer described above which is indicative of the longitudinal position of the nut assembly 64 on the linear screw 62 and a (e.g. back EMF) signal from the motor 52 which is indicative of the speed and load under which the motor 52 is operating. In accordance with these and other inputs described in the aforementioned patent application, the CPM controller provides signals to the electric motor 52 to control the speed, direction and torque of the motor as well as the force or load under which automatic motor reversal is effected.

The geometrical relationships (e.g. the relative sizes, shapes, and positions) which exist between the main housing unit 22, the yoke member 28, the first link mechanism 36, the second link mechanism 76 and the motion producing device 50 are chosen to minimize (e.g. in light of practical considerations), or at least reduce, the degree of variance which occurs in the effective "gearing ratio" of the linkage-type motion conversion mechanism that converts the reciprocating movement of the output member of the motor 52 into the oscillatory movement of the hand-supporting assembly 46 over the operative range of movement of the linkage-type motion conversion mechanism. The term "gearing ratio" as employed herein does not imply that gears are utilized in the linkage-type motion conversion device. It merely refers to the multiplication or division of a magnitude of a driving force, or alternately, to the division or multiplication of the amount of movement produced by the driving force, which occurs when the driving force is transmitted through the motion conversion mechanism. Such a minimization of or reduction in the degree of variance in the effective gearing ratio of the linkage-type motion conversion device simplifies the electric motor selection in the CPM design process in that it enables a more appropriately sized (e.g. smaller) motor to be effectively employed in the wrist CPM 20.

Specifically, the geometrical relationships between the motion producing device 50, the first and second link mechanisms 36, 76, the yoke member 28 and the main housing unit 22 are such that:

a) during driving movement of the driving motor output shaft, a ratio ($d\psi/dx$) is established between a rate of change of angular movement of the first link mechanism 36 and a rate of change of linear movement of the output member of the motion producing device 50 for each position of the output member over an entire operative range of positions through which the output member is adapted to travel according to the relationship:

$$\frac{d\phi}{dx} = \frac{a}{m^2} - \frac{x}{m^2} * \frac{m^2 + (c^2 + a^2)}{\sqrt{4R^2m^2 - (x^2 - c^2)^2}}$$

wherein $\psi$=the angular position of the first link mechanism 36 with respect to the axis of the first pivotal connection;

a=the distance from an axis of the first pivotal connection to a reference point on a reference line, wherein the reference line is defined by a direction of movement of the output member of the motion producing device 50, and wherein the reference point is established such that a line from the axis of the first pivotal connection to the reference point is orthogonal to the reference line;

x=the distance (e.g. either positive or negative) between the reference point and an axis of the third pivotal connection;

$m^2=a^2+x^2$; and $c^2=L^2-R^2-a^2$, wherein L is the distance between the third pivotal connection and the second pivotal connection; and R is the distance between the first pivotal connection and the second pivotal connection; and (b) during driving movement of the drive motor output shaft, and over the entire operative range of positions through which the output member is adapted to travel, a maximum value of the ratio between the rate of change of angular movement of the first link mechanism 36 and the rate of change of linear movement of the output member of the motion producing device 50 is no greater than twice a minimum value of the ratio between the rate of change of angular movement of the first link mechanism 36 and the rate of change of linear movement of the output member of the motion producing device 50. In other words, the geometrical relationships between the yoke member 28 supported by the main housing unit 22, the first and second link mechanisms 36, 76, and the motion producing device 50 are such that during reciprocating movement of the output member of the motion producing device 50 and over the entire operative range of positions through which the output member is adapted to travel, a maximum value of an effective gearing ratio between the output member of the motion producing device 50 and the first link mechanism 36 is no greater than twice a minimum value of the effective gearing ratio between the output member of the motion producing device 50 and the first link mechanism 36.

Figure 12:
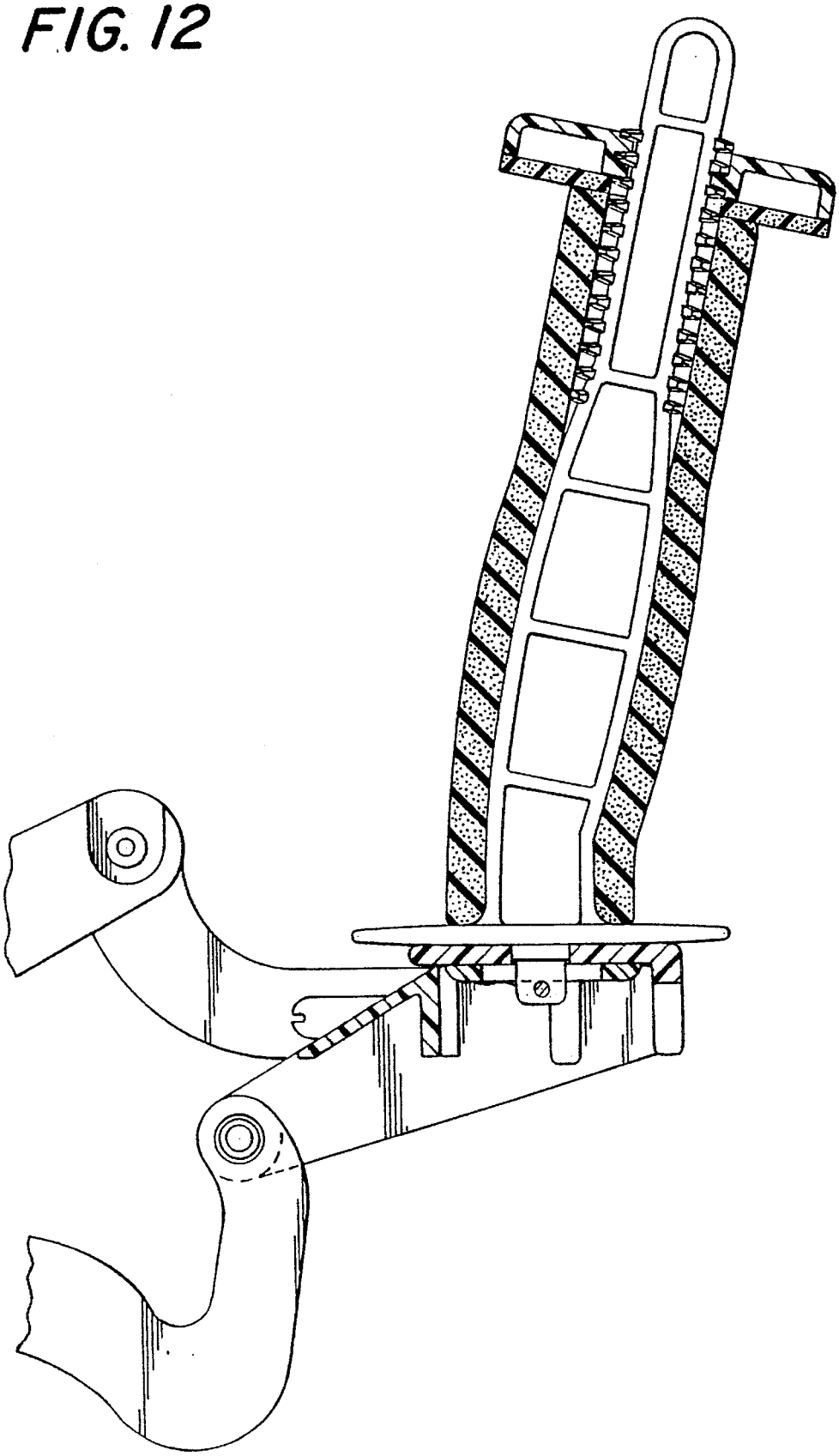
FIG. 12 is a cross-sectional view of an alternate hand-supporting member which may be employed in the wrist CPM of FIG. 1.
Figure 13:
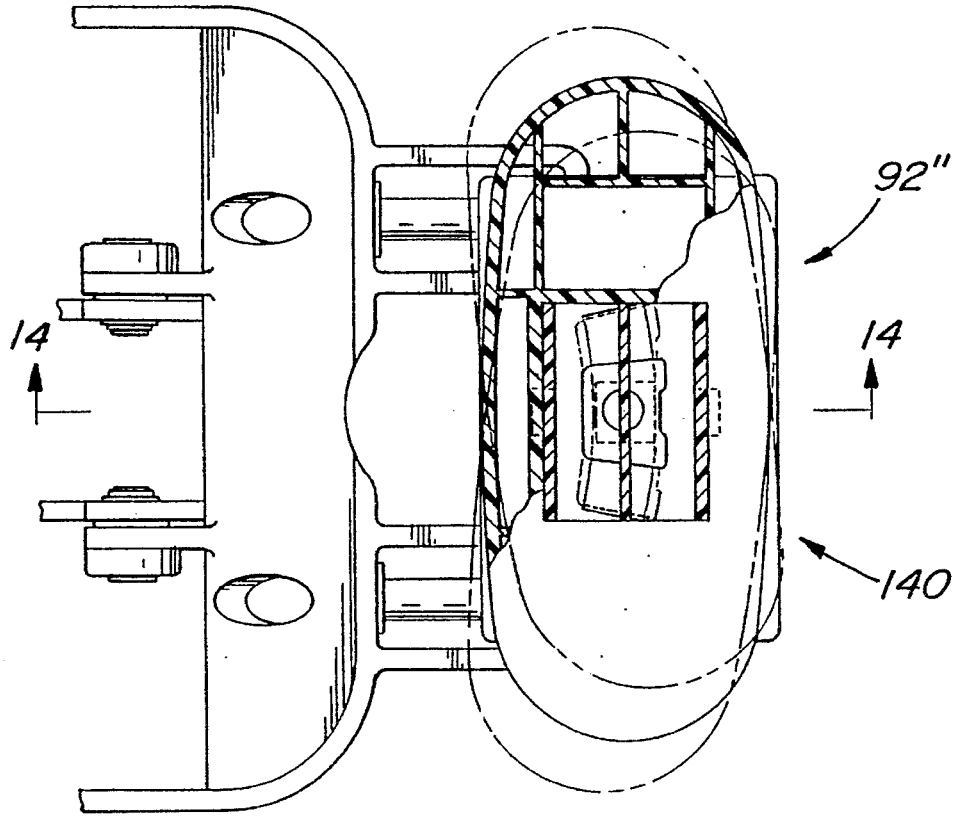
FIG. 13 is a cross-sectional view of yet another hand-supporting member which may be employed in the wrist CPM of FIG. 1.
Figure 14:
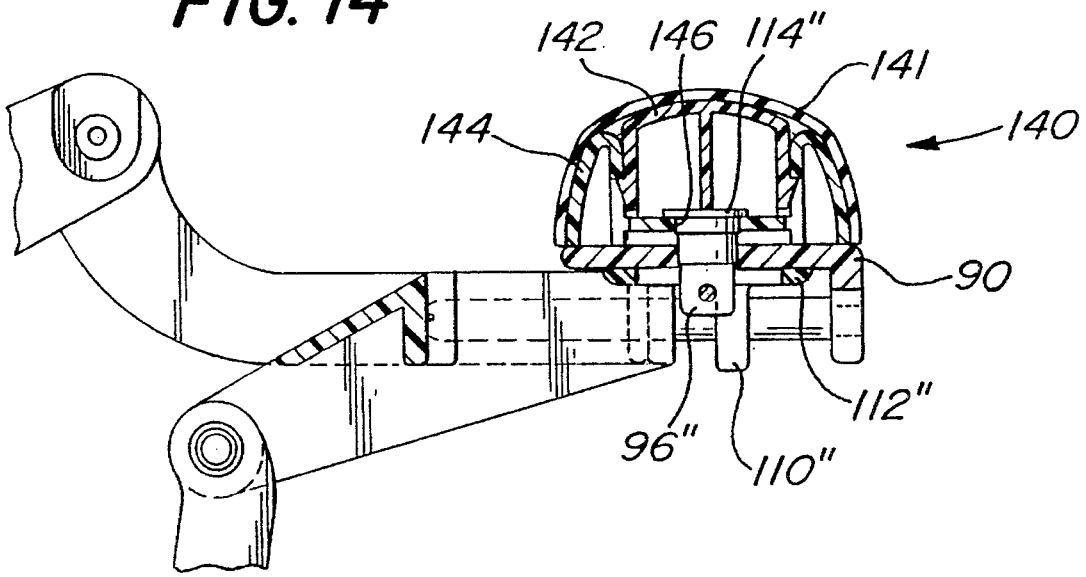
FIG. 14 is a longitudinal cross-sectional view taken along lines 14—14 in FIG. 13.

FIGS. 12 to 14 reveal other hand-supporting members which may be attached to the supporting plate 90 of the wrist CPM 20 of FIGS. 1 to 11.

Referring to FIG. 12, there is shown a generally vertically extending padded hand-supporting member 132 which includes a base plate portion 134 and a generally vertically extending frame portion 136 integral therewith. A pad member 138 encircles the frame portion 136. A lock knob 112' is provided to removably attach the base plate portion 134 to the supporting plate 90. The hand-supporting member 132 is attached to the supporting plate 90 in a manner generally identical to that described above in connection with attaching the base plate 98 to the supporting plate 90, except that arcuate sliding movement is not possible, since the hand-supporting member 132 does not include an arcuate slot. Hence, the hand-supporting member 132 is locked to the supporting plate 90 when the locking pins 106' are positioned over the second set of cam formations **108*b*'. The hand-supporting member 132 is employed in the wrist CPM 20 when it is desired to flex the wrist while the hand is disposed in a substantially vertical orientation (as opposed to a substantially horizontal orientation for the embodiment of FIGS. 1–11). The pad member 138 is trimmable with scissors or other cutting devices to accommodate different hand widths. A screw-down padded flange 138*a* and the base slate portion 134 keep the user's hand positioned on the pad member 138 between the screw-down padded flange 138*a* and the base plate portion 134**.

Referring now to FIGS. 13 and 14, there is shown a substantially horizontally disposed hand-supporting member 140 (made from plastic or other suitable material) around which a user's fingers are adapted to curl. A resilient pad 141 covers the hand-supporting member 140 which is mounted on the supporting plate 90 by means of an assembly identical to that described above in connection with FIGS. 1–11 which includes an arcuate slide assembly 92", stop elements 110", a lock knob 112", and retaining flanges 114". The hand-supporting member 140 comprises first and second interfitted portions 142, 144 which are adapted to be snap-fit together, capturing the sliding member 96" between the first interfitted portion 142 and an apertured flange 146 of the second interfitted portion 144.

From the foregoing description, it can be seen that the present invention comprises a wrist CPM having a linkage-type motion conversion assembly for efficiently converting a reciprocating motion of an output member of a motion producing device into an oscillatory pivoting motion of a hand-supporting member. It will be appreciated by those skilled in the art that changes and modifications may be made to the above described embodiment(s) without departing from the inventive concept thereof. It is understood, therefore, that the present invention is not limited to the particular embodiment(s) disclosed, but is intended to include all modifications and changes which are within the scope and spirit of the invention as defined by the appended claims.

What is claimed is:

1. A therapeutic passive motion device for effecting wrist movement in a user, the user having a forearm and a hand connected by a wrist, and the device comprising:

a main housing unit;

a yoke member rigidly supported by and extending outwardly from the main housing unit;

a first link mechanism pivotally connected to an end of the yoke member remote from the main housing unit at a first pivotal connection;

a hand-supporting assembly mounted on the first link mechanism;

wherein the main housing unit is adapted to be secured to the forearm of the user in such a manner that the wrist of the user is in general alignment with the first pivotal connection and the hand of the user is supported by the hand-supporting assembly, and wherein the device further comprises:

a motion producing device located within the main housing unit and having an output member which undergoes reciprocal movement; and a second link mechanism pivotally connected to the first link mechanism at a second pivotal connection and to the output member of the motion producing device at a third pivotal connection, wherein the second link mechanism is adapted to transform the reciprocal movement of the output member of the motion producing device into an oscillatory movement of the first link mechanism.

2. The therapeutic passive motion device as recited in claim 1, wherein the first link mechanism is generally V-shaped and defines an apex and two leg portions extending from the apex, and wherein the hand-supporting assembly is mounted on the first link mechanism at a position near the apex.

3. The therapeutic passive motion device as recited in claim 2, wherein a first one of the two leg portions comprises an end portion remote from the apex, wherein a second one of the two leg portions comprises an end portion remote from the apex, wherein the first pivotal connection connects the end portion of the first leg portion to the end of the yoke member, and wherein the second pivotal connection connects the end portion of the second leg portion to a first end portion of the second link mechanism.

4. The therapeutic passive motion device as recited in claim 3, wherein the second link mechanism comprises a second end portion, and wherein the second end portion of the second link mechanism is pivotally connected to the output member of the motion conversion device.

5. The therapeutic passive motion device as recited in claim 1, wherein the hand-supporting assembly is mounted for limited movement relative to the first link mechanism.

6. The therapeutic passive motion device as recited in claim 1, wherein the geometrical relationships between the main housing unit, the yoke member, the first and second link mechanisms and the motion producing device define means for ensuring that during reciprocating movement of the output member of the motion producing device and over the entire operative range of positions through which the output member is adapted to travel, a maximum value of a ratio between a rate of change of angular movement of the first link mechanism and a rate of change of linear movement of the output member of the motion producing device is no greater than twice a minimum value of the ratio between the rate of change of angular movement of the first link mechanism and the rate of change of linear movement of the output member of the motion producing device.

7. The therapeutic passive motion device as recited in claim 1, wherein the geometrical relationships between the yoke member, the first and second link mechanisms and the motion producing device define means for ensuring that during reciprocating movement of the output member of the motion producing device and over the entire operative range of positions through which the output member is adapted to travel, a maximum value of an effective gearing ratio between the output member of the motion producing device and the first link mechanism is no greater than twice a minimum value of the effective gearing ratio between the output member of the motion producing device and the first link mechanism.

8. The therapeutic passive motion device as recited in claim 1, wherein the motion producing device is mounted within the main housing unit and comprises:

a drive motor having a drive motor output which undergoes a driving movement; and a motion conversion device connected to the drive motor, wherein the motion conversion device converts the driving movement of the drive motor into the reciprocal movement of the output member of the motion producing device.

9. The therapeutic passive motion device as recited in claim 8, wherein the geometrical relationships between the yoke member supported by the main housing unit, the first and second link mechanisms and the motion producing device define means for ensuring that a) during driving movement of the driving motor output, a ratio ($d\psi/dx$) is established between a rate of change of angular movement of the first link mechanism and a rate of change of linear movement of the output member of the motion producing device for each position of the output member over an entire operative range of positions through which the output member is adapted to travel according to the relationship $$\frac{d\phi}{dx} = \frac{a}{m^2} - \frac{x}{m^2} * \frac{m^2 + (c^2 + a^2)}{\sqrt{4R^2m^2 - (x^2 - c^2)^2}}$$

wherein $\psi$=the angular position of the first link mechanism with respect to an axis of the first pivotal connection;

a=the distance from the axis of the first pivotal connection to a reference point on a reference line, wherein a reference line is defined by a direction of movement of the output member of the motion producing device, and wherein the reference point is established such that a line from the axis of the first pivotal connection to the reference point is orthogonal to the reference line;

x=the distance between the reference point and an axis of the third pivotal connection;

$m^2=a^2+x^2$; and $c^2=L^2-R^2-a^2$, wherein L is the distance between the third pivotal connection and the second pivotal connection; and R is the distance between the first pivotal connection and the second pivotal connection;

and b) during driving movement of the drive motor output, and over the entire operative range of positions through which the output member is adapted to travel, a maximum value of the ratio between the rate of change of angular movement of the first link mechanism and the rate of change of linear movement of the output member of the motion producing device is no greater than twice a minimum value of the ratio between the rate of change of angular movement of the first link mechanism and the rate of change of linear movement of the output member of the motion producing device.

10. The therapeutic passive motion device as recited in claim 9, wherein the motion conversion device comprises a screw and nut assembly, wherein the screw is driven by the driving movement of the driving motor output, and wherein the nut constitutes the output member of the motion producing device and is pivotally connected to the second link mechanism.

11. The therapeutic passive motion device as recited in claim 10, wherein a gear transmission is drivingly interposed between the drive motor .output and the screw, and the driving movement of the drive motor output drives the screw through the gear transmission.

12. The therapeutic passive motion device as recited in claim 8, wherein the motion conversion device comprises a screw and nut assembly, wherein the screw is driven by the driving movement of the driving motor output, and wherein the nut constitutes the output member of the motion producing device and is pivotally connected to the second link mechanism.

13. The therapeutic passive motion device as recited in claim 12, wherein a gear transmission is drivingly interposed between the drive motor output and the screw, and the driving movement of the drive motor output drives the screw through the gear transmission.

14. The therapeutic passive motion device as recited in claim 1, wherein the hand-supporting assembly is connected to the first link mechanism through a linear slide assembly which permits limited movement of the hand-supporting assembly in directions generally toward and away from the first pivotal connection.

15. The therapeutic passive motion device as recited in claim 14, wherein the linear slide assembly includes at least one slide pin connected to the hand-supporting assembly and at least one guideway formed within the first link mechanism.

16. The therapeutic passive motion device as recited in claim 15, wherein the hand-supporting assembly includes a supporting plate and a hand-supporting member, wherein the at least one slide pin is connected to the supporting plate, wherein the hand-supporting member is connected to the supporting plate through an arcuate slide assembly, and wherein a line of movement of the arcuate slide assembly extends generally transversely to a line of movement of the linear slide assembly.

17. The therapeutic passive motion device as recited in claim 16, further including a locking assembly which selectively locks a position of the hand-supporting member relative to the supporting plate.

18. The therapeutic passive motion device as recited in claim 1, wherein the yoke member comprises a pair of spaced-apart arms, and wherein the first link mechanism comprises a first bifurcated leg portion which is pivotally connected to the pair of spaced-apart arms at the first pivotal connection.

19. The therapeutic passive motion device as recited in claim 1, wherein the yoke member is integrally formed with an upper portion of the main housing unit and comprises a pair of spaced-apart arms which are pivotally connected to the first link mechanism at the first pivotal connection.

20. The therapeutic passive motion device as recited in claim 19, wherein the spaced-apart arms are each provided with a plurality of strengthening ribs.

21. The therapeutic passive motion device as recited in claim 1, wherein the hand-supporting assembly includes a supporting plate mounted on the first link mechanism and a hand-supporting member removably attached to the supporting plate.

22. The therapeutic passive motion device as recited in claim 21, wherein the hand-supporting member is removably attached to the supporting plate by a rotatable lock knob.

23. The therapeutic passive motion device as recited in claim 21, wherein a plurality of different hand-supporting members are provided and means are provided for interchangeably attaching each of the hand-supporting members to the supporting plate.

24. The therapeutic passive motion device as recited in claim 23, wherein a rotatable lock knob is provided for interchangeably attaching each of the hand-supporting members to the supporting plate.

25. The therapeutic passive motion device as recited in claim 10, wherein the driving movement of the drive motor output drives the screw through a gear transmission, and wherein the gear transmission includes a drive gear and a driven gear, the drive gear being attached to the drive motor output and engaging the driven gear which drives the screw.

26. The therapeutic passive motion device as recited in claim 12, wherein the driving movement of the drive motor output drives the screw through a gear transmission, and wherein the gear transmission includes a drive gear and a driven gear, the drive gear being attached to the drive motor output and engaging the driven gear which drives the screw.

* * * * *